US005699757A

United States Patent [19]

Wollny et al.

[11] Patent Number: 5,699,757

[45] Date of Patent: Dec. 23, 1997

[54] INTERNAL COMBUSTION ENGINE

[76] Inventors: Georg B. Wollny, Sudetenstrasse 19, D-82515 Wolfratshausen, Germany; Marian Chmiel, ul. Morcinka 2a/5, PL 57-300 Klodzko, Poland

[21] Appl. No.: 718,676

[22] Filed: Sep. 24, 1996

[51] Int. Cl.[6] ..... F02B 53/00

[52] U.S. Cl. ..... 123/18 R

[58] Field of Search ..... 123/18 R, 61 R

[56] References Cited

U.S. PATENT DOCUMENTS

| | | | |
|---|---|---|---|
| 1,113,262 | 10/1914 | Twombly | 123/18 R |
| 1,468,516 | 9/1923 | Schiller | 123/18 R |
| 1,940,788 | 12/1933 | Davis | 123/18 R |
| 3,190,270 | 6/1965 | Peterson | 123/18 R |
| 3,408,991 | 11/1968 | Davis | 123/18 R |
| 4,599,976 | 7/1986 | Meuret | 123/18 R |
| 4,884,532 | 12/1989 | Tan et al. | 123/18 R |
| 5,152,254 | 10/1992 | Sakita | 123/18 R |
| 5,228,414 | 7/1993 | Crawford | 123/18 A |

FOREIGN PATENT DOCUMENTS

| | | |
|---|---|---|
| 2639530 | 3/1978 | Germany . |
| 4324097 | 1/1995 | Germany . |

*Primary Examiner*—David A. Okonsky
*Attorney, Agent, or Firm*—Thomas R. Shaffer, Esq.

[57] ABSTRACT

A swivel-blade internal combustion engine which produces gas pressure energy for two-cycle and four-cycle operation is disclosed. The engine includes a reciprocating shaft (24) and a reciprocating element (9) supported on the reciprocating shaft. The reciprocating element (9) has a working surface adapted and positioned to receive the gas pressure energy for producing an oscillating pendulum moment in the reciprocating element. The working surface of the reciprocating element preferably has a trapezoidal shape which is rounded on the head. A rocker arm system (16) is provided for converting the pendulum moment into the torque of a crankshaft. The rocker arm system includes a swing arm (21) fixed solidly on the reciprocating shaft (24) and an articulated connecting rod (20) connected to the swing arm and to the crankshaft through which the pendulum moment is passed to the crankshaft.

12 Claims, 7 Drawing Sheets

INTERNAL COMBUSTION ENGINE

BACKGROUND OF THE INVENTION

1. Field of the Invention

The invention is composed of a swivel-blade internal combustion engine. The system is based on the operating cycle of a two-cycle and/or four-cycle piston engine with internal combustion, but in which the thrust-reversing motion is replaced by a swivel-reversing motion. The construction is suitable for both spark-ignition and diesel engines as well as the hot bulb engine.

2. Description of the Prior Art

The publications DE-OS 26 39 530 and DE 43 24 097 A1 are cited as the prior art. The publication DE-OS 26 39 530 describes a two-cycle two-chamber swivelling-piston engine with two swivelling pistons. In this familiar arrangement, the gas pressure produced is taken up by a rectangular surface of the swivelling piston. The angular momentum produced is transferred to the crankshaft with the aid of a connecting rod connected directly to the swivelling piston.

The publication DE 43 24 097 A1 describes a four-cycle internal combustion engine, but which deviates too widely from the principle of the object of application.

SUMMARY OF THE INVENTION

The invention proposes the construction of an engine with a high efficiency, low wear and small dimensions.

According to the invention, this goal is achieved by the provision of a swivel-blade internal combustion engine which produces gas pressure energy for two-cycle and four-cycle operation. The engine comprises a reciprocating shaft and a reciprocating element supported on said reciprocating shaft, said reciprocating element having a working surface adapted and positioned to receive the gas pressure energy for producing an oscillating pendulum moment in the reciprocating element, said working surface having a shape which deviates from a rectangular form. Rocker arm means are provided for converting the pendulum moment into the torque of a crankshaft. The rocker arm means further comprises a swing arm fixed solidly on the reciprocating shaft and an articulated connecting rod connected to the swing arm and to the crankshaft through which the pendulum moment is passed to the crankshaft.

Preferably, the working surface of the reciprocating element has a trapezoidal shape which is rounded on the head.

The reciprocating element may be equipped with two blades, two combustion chambers and one working chamber or with one blade, one combustion chamber and one working chamber.

Preferably, the swing arm spans a pendulum angle $\beta w$ of a minimum of 90° and a maximum of 130° and the angle p (between the swing arm and the connecting rod) moves in a range greater than 0° up to a maximum of 30°.

It is also preferred to provide a change in the compression through a change in the length of the swing arm by means of eccentricity of the swing arm pin.

With the engine design of the present invention, a high pendulum moment is obtained through the long arm of the rocker arm means as a result of the gas pressure and the large pendulum angle. This principle and the kinematic arrangement thus facilitate a more effective utilization of the energy. In comparison with the constructions of conventional engines, this involves a number of newer and more thoroughly analyzed factors that in their entirety offer additional objects and advantages, such as:

1. A smaller and lighter engine block.
2. Low production costs.
3. The different radii of the angular motion (difference in the decrement of the volume on the larger radius in relation to the volume on the smaller radius) additionally force the flow of air or the mixture in the radial direction (inward). This creates better conditions for the mixing of both fuel and air as well as the flame front after ignition and results in a better combustion.
4. The possible use of roller-solid bearings induces a lower frictional resistance, through which a longer service life is obtained.
5. A large piston displacement (through the pendulum stroke) with a smaller stroke of the center of gravity of the pendulum mass and a shorter angular path of the mass center.
6. The system can be used for both extraneous and self-ignition.
7. The round form of construction results in a high rigidity.
8. The possible use of a gear control with overlying camshafts caused by small axle bases of the wheels.
9. Alleviation of the swing arm-crankshaft region of the inertial forces of the pendulum masses with respect to the braking of the masses during an increase in the compression pressure in the combustion chamber in the end phase of each pendulum period.
10. The use of a very short connecting rod results in:
    a. a smaller connecting rod mass and a greater buckling resistance,
    b. a rapid increase in the theoretical connecting rod arm (in the crank system), which is of great importance in the initial phase of the alleviation, i.e., during alleviation of the high gas pressure.
11. The variation in length of the swing arm (21) through the eccentricity of the pin facilitates both an extraneous and self-ignition (diesel) with an almost identical construction.

BRIEF DESCRIPTION OF THE DRAWINGS

Further advantages and features of the invention are explained in greater detail with reference to the examples shown in the accompanying Figures, in which.

DETAILED DESCRIPTION OF THE PREFERRED EMBODIMENT

Figure 1A:
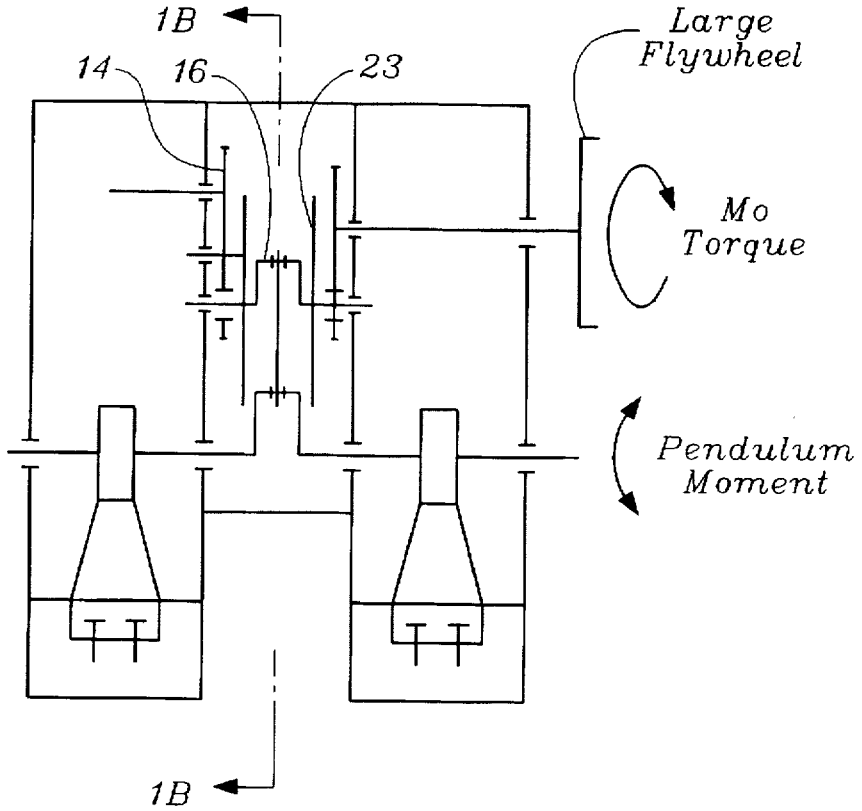
FIGS. 1A and 1B show a scheme of the kinematics.
Figure 1B:
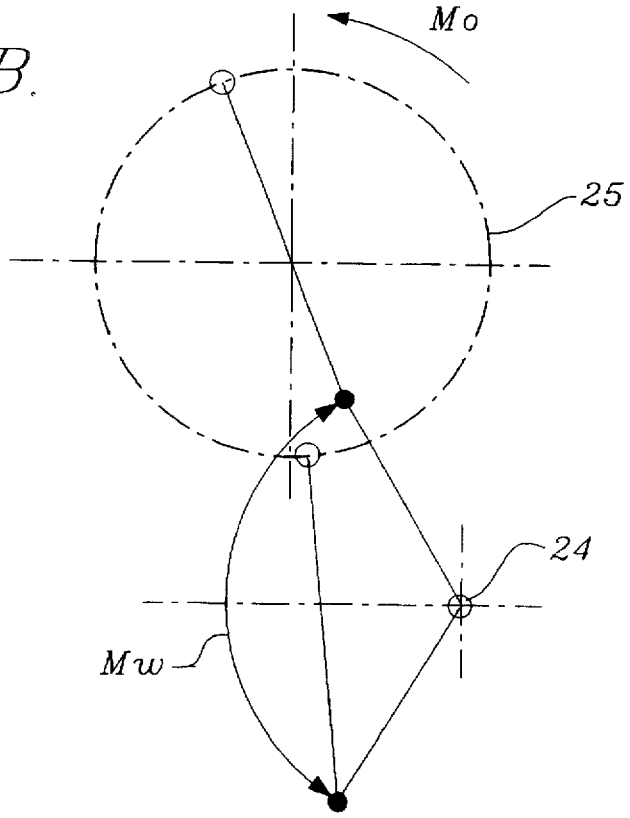

Referring to the Figures, the following legends and reference numerals are utilized to identify and describe the various components and elements as shown in the drawings.

Figure 2:
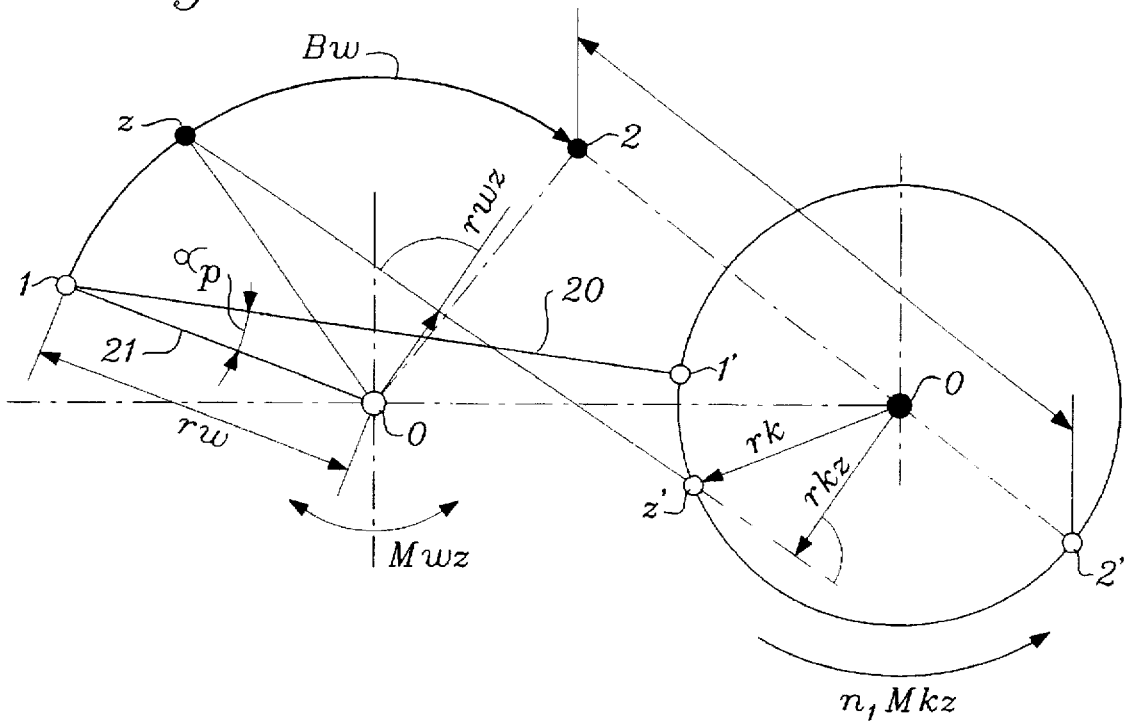
FIG. 2 shows the position of the swing arm relative to the crank system.
Figure 3C:
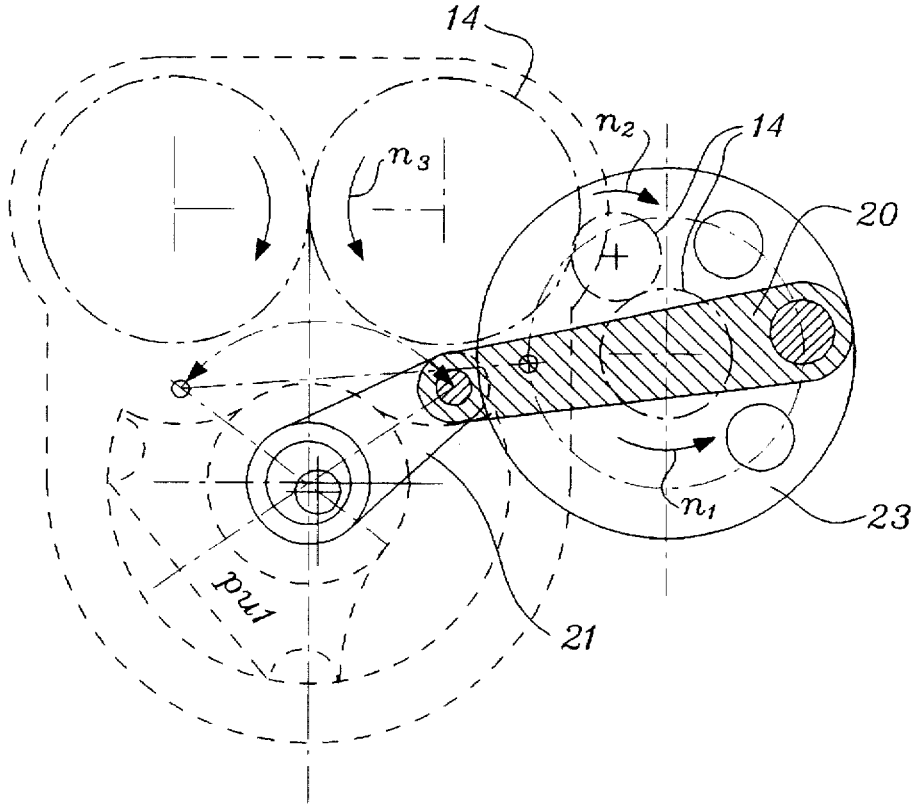
FIGS. 3A, 3B and 3C show a four-cycle engine, assembly.
Figure 3A:
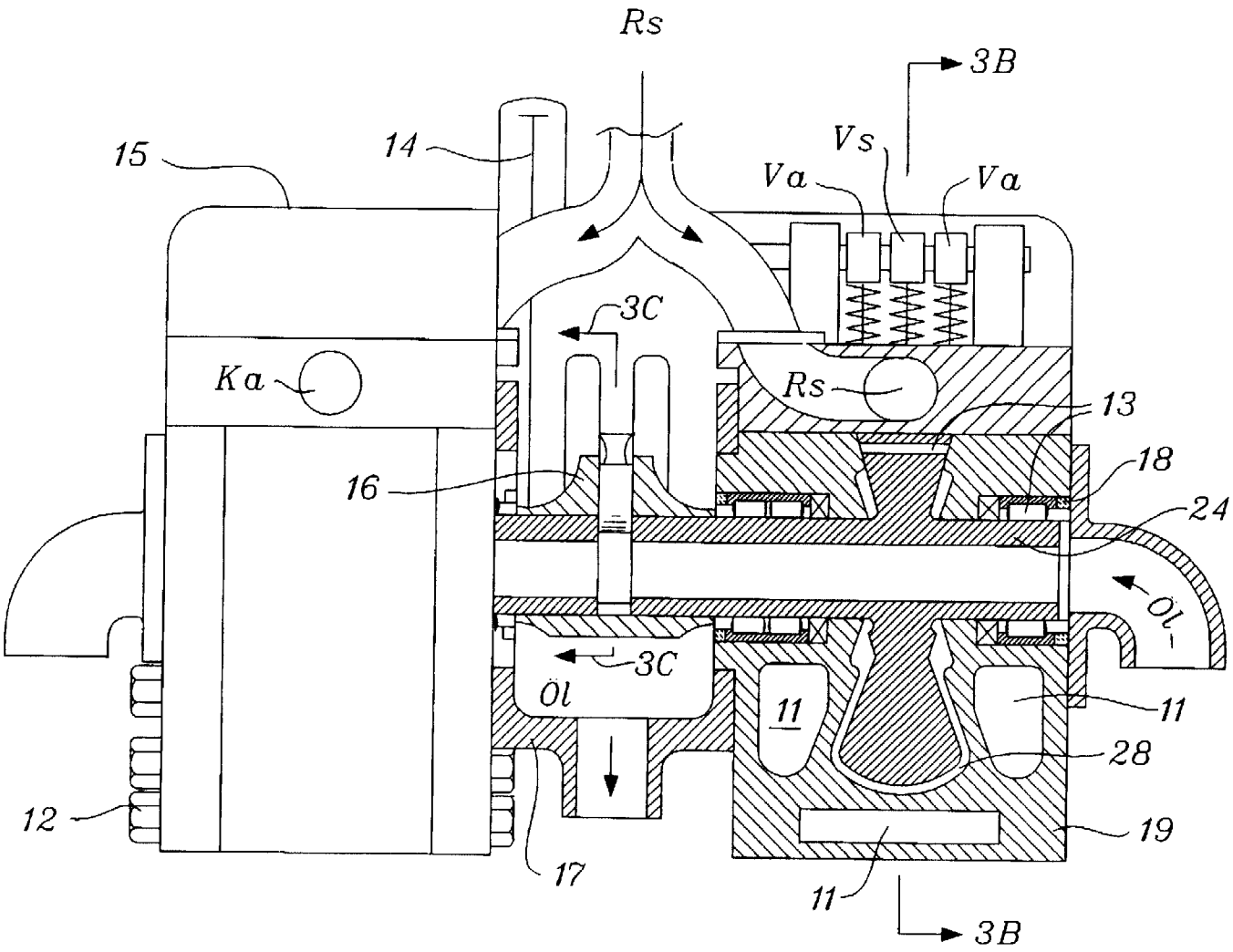
Figure 3B:
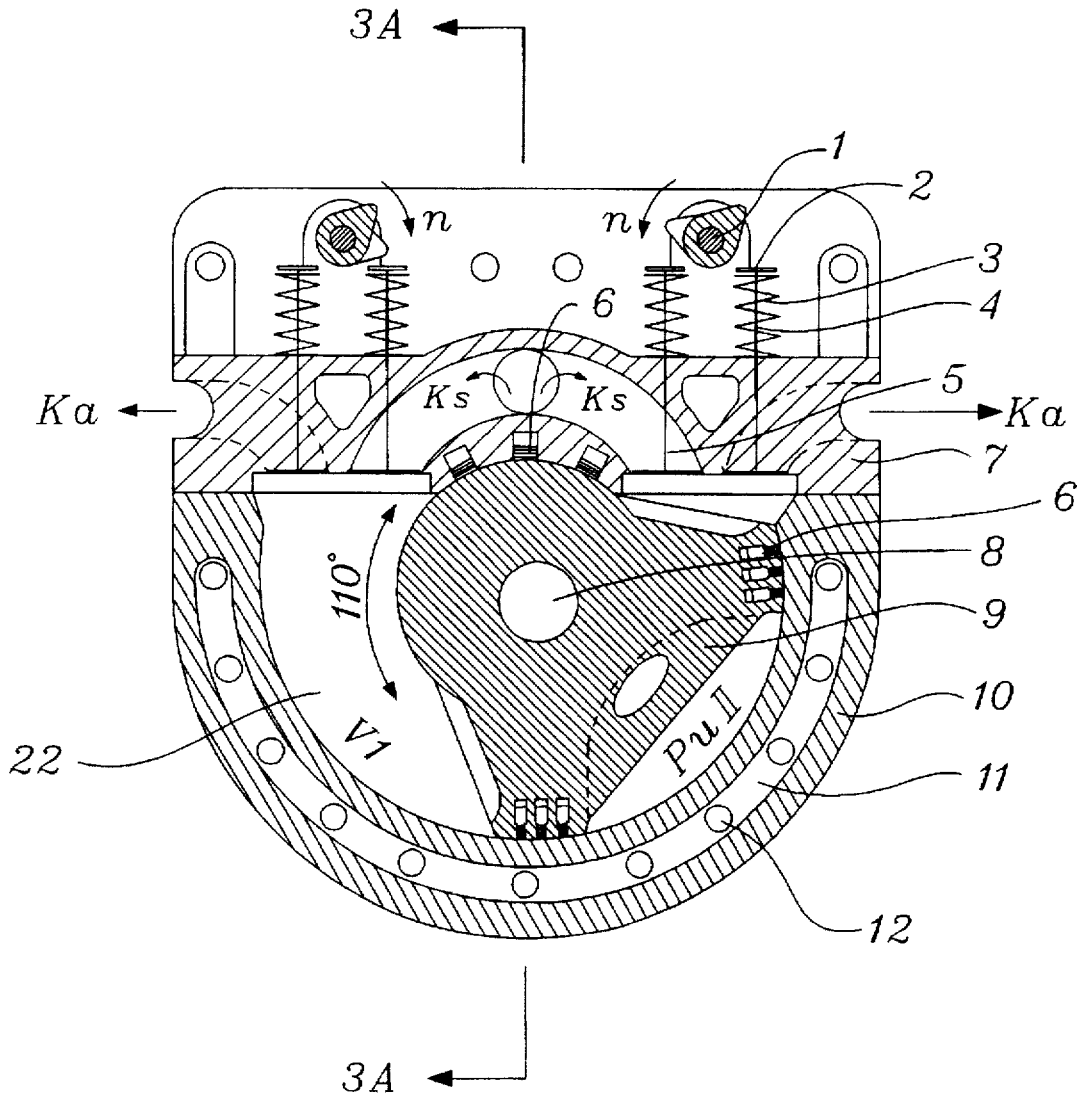
Figure 4A:
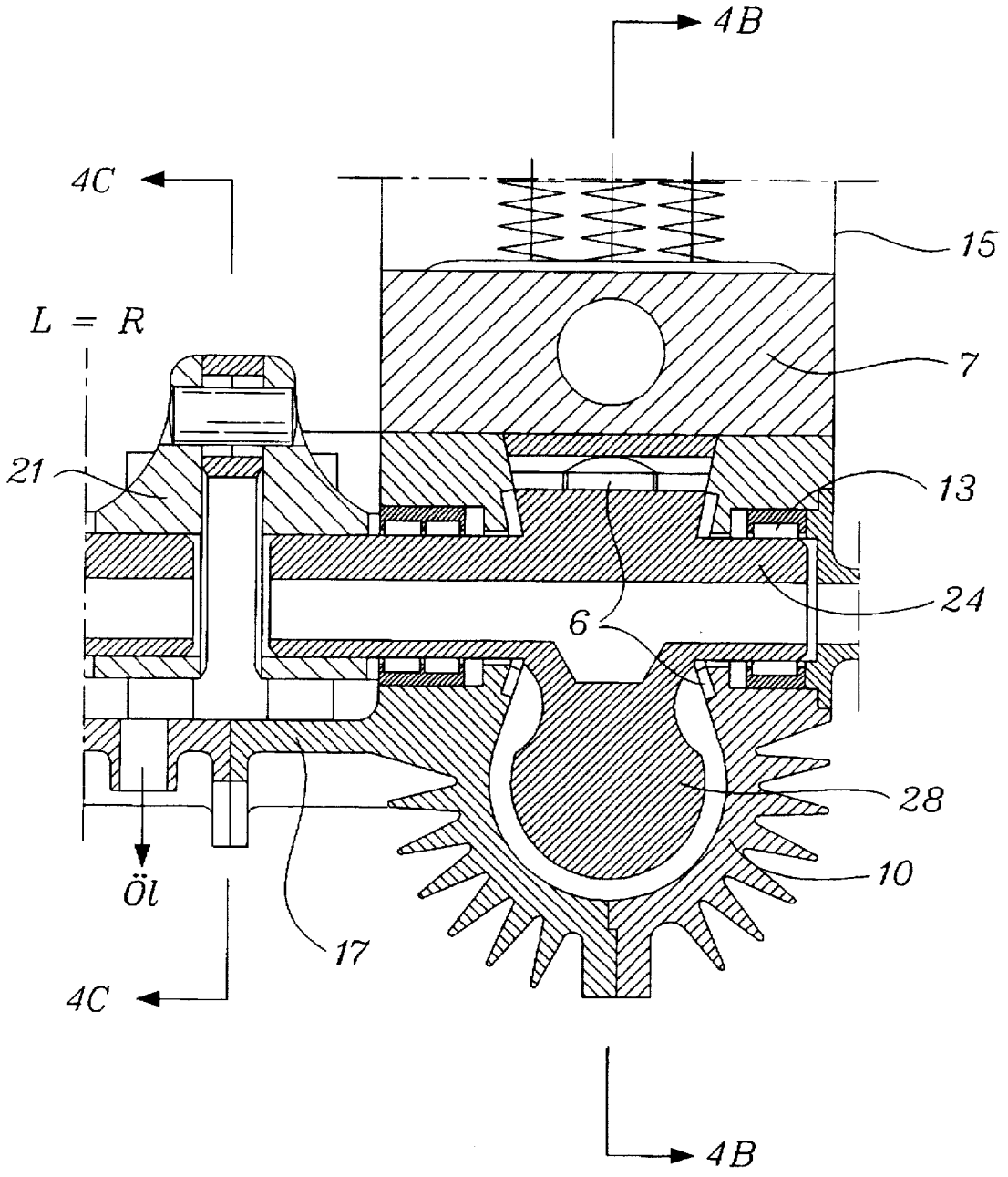
FIGS. 4A, 4B and 4C show a two-cycle engine with one-blade pendulum element.
Figure 4B:
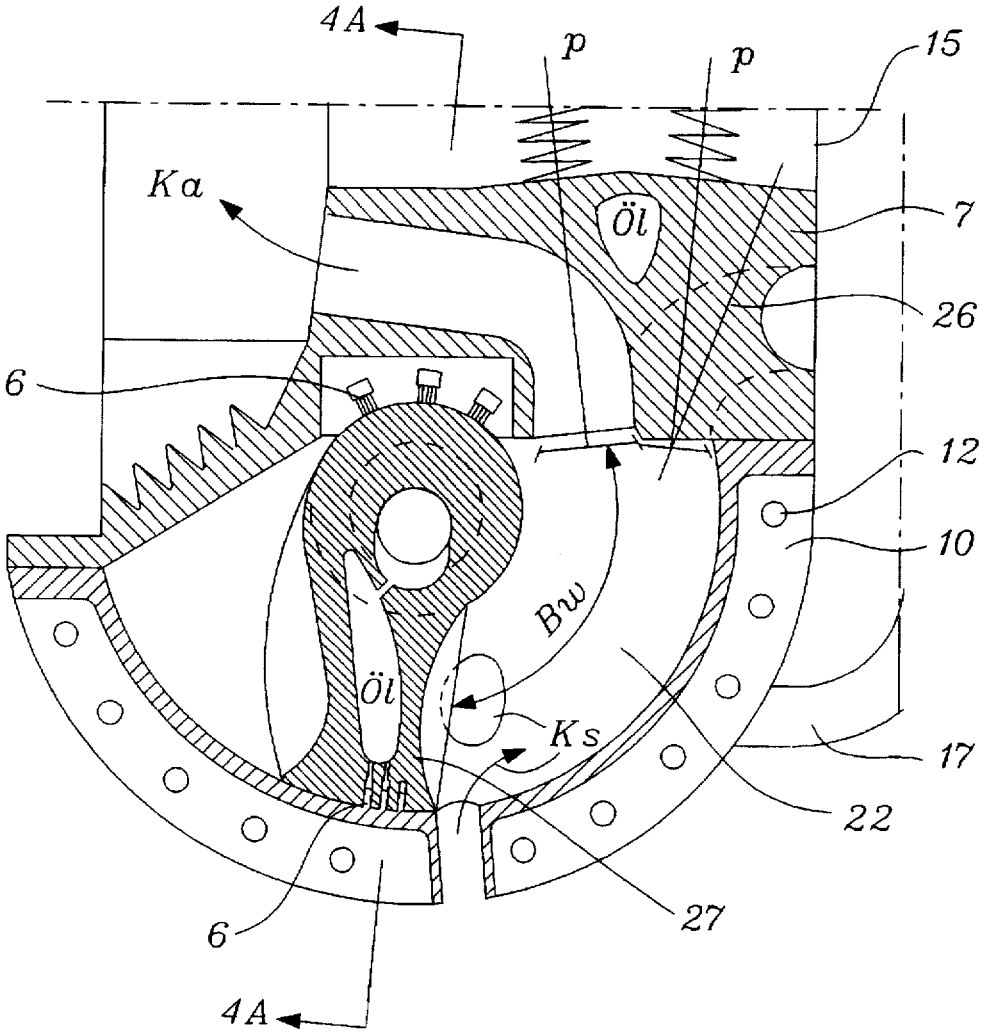
Figure 4C:
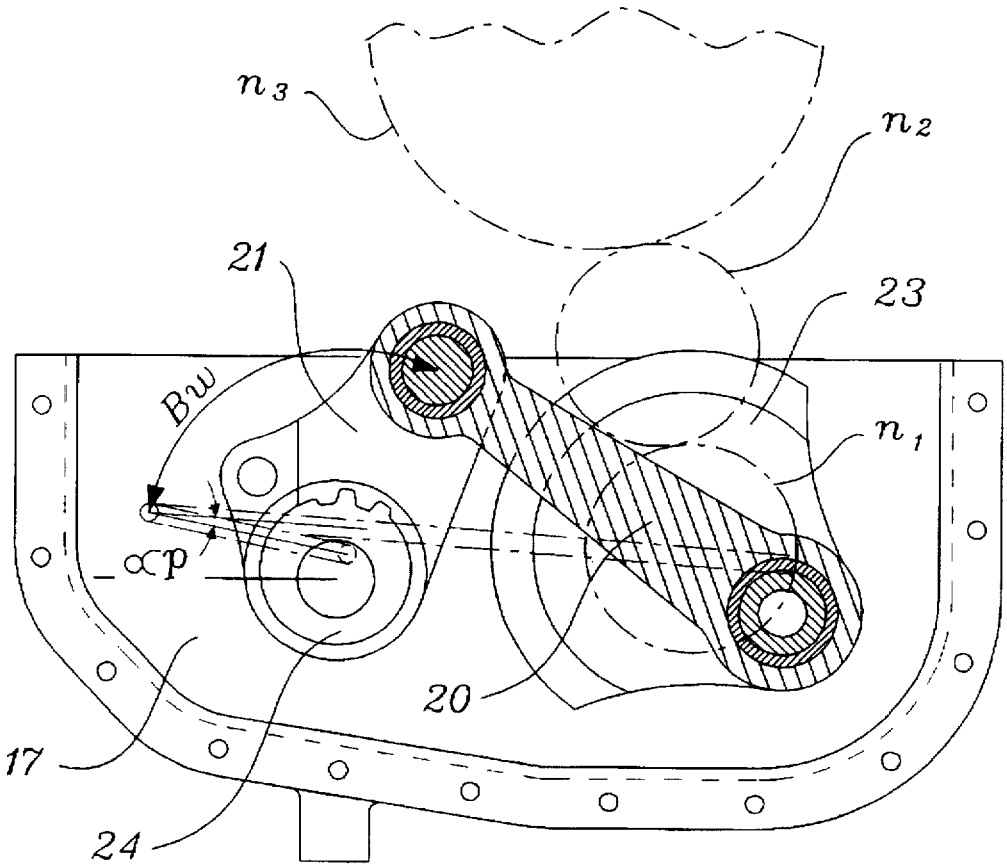
Figure 1A:
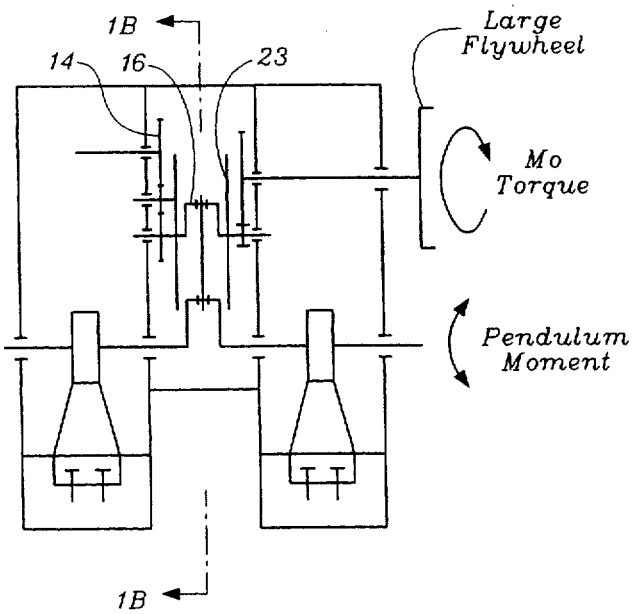
Figure 1B:
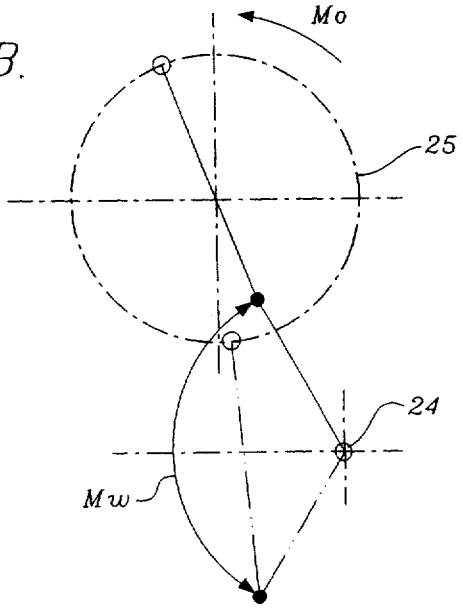
Figure 2:
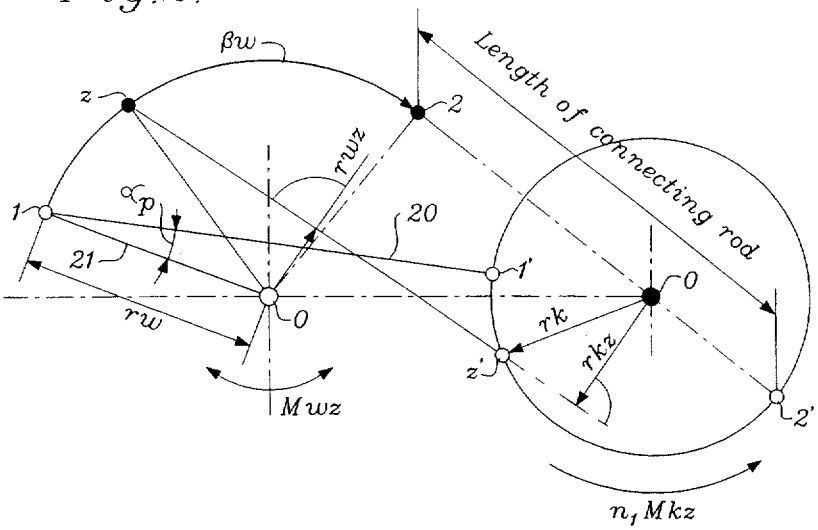
Figure 3C:
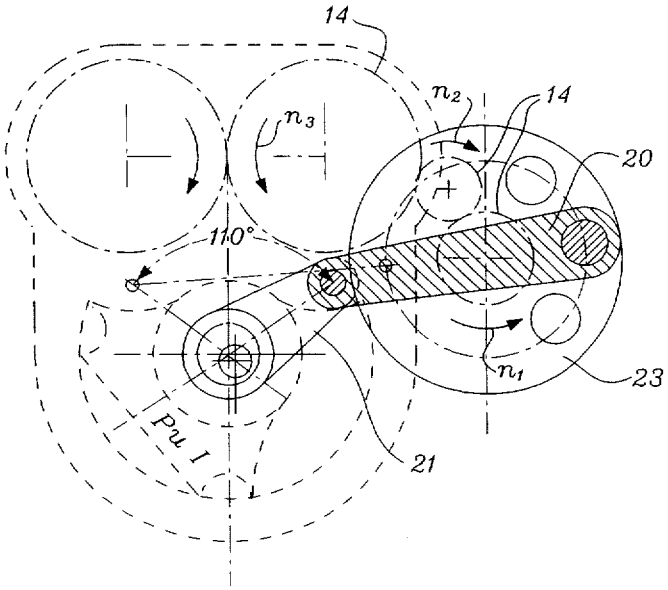
Figure 3A:
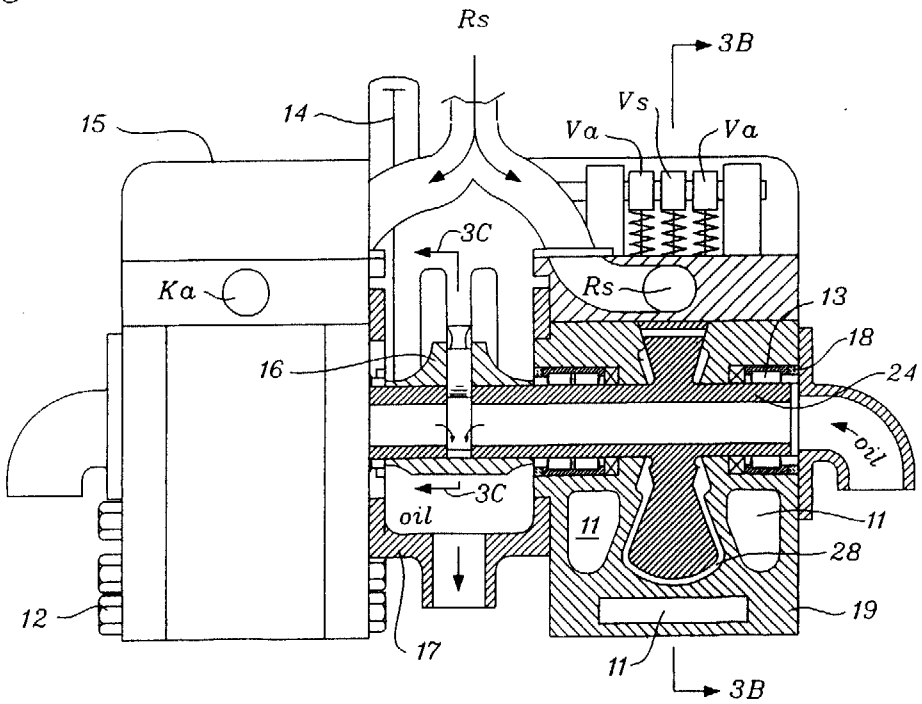
Figure 3B:
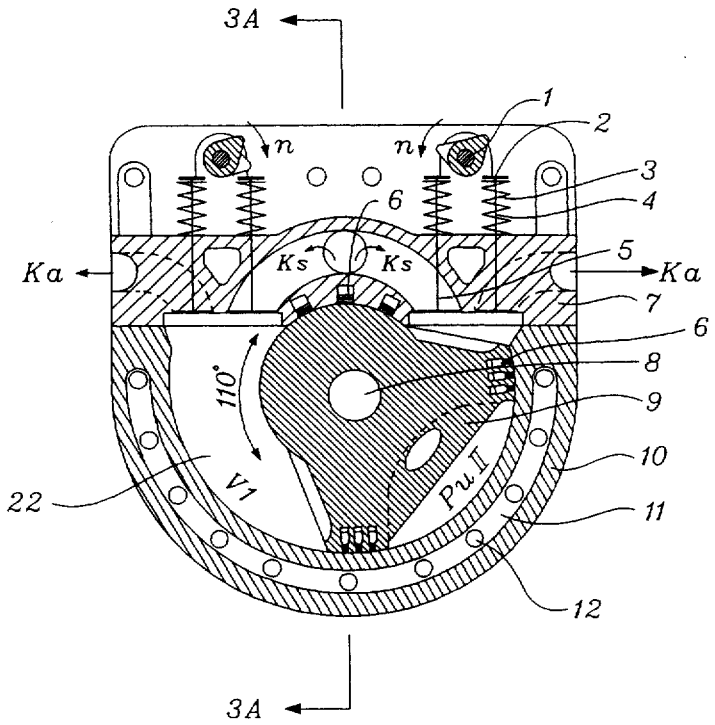
Figure 4A:
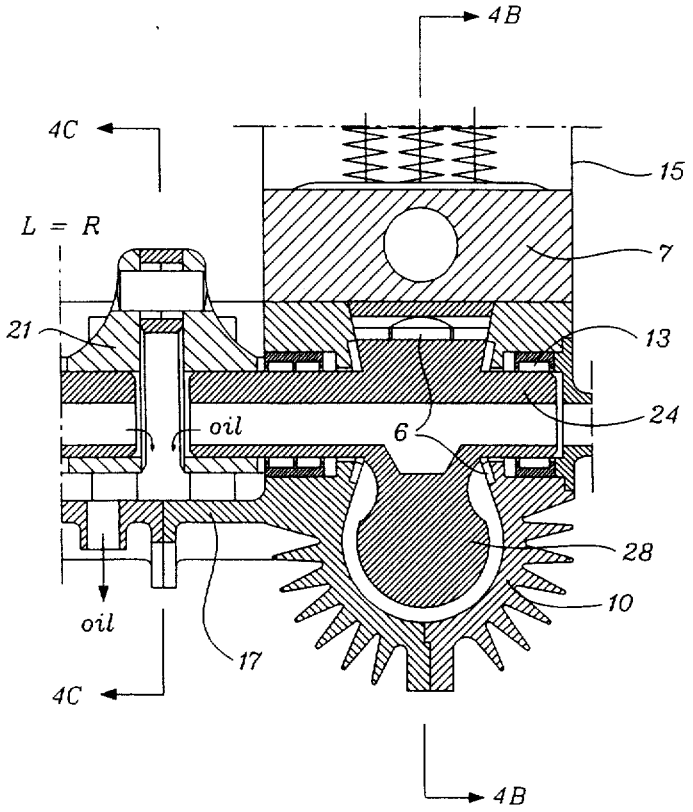
Figure 4B:
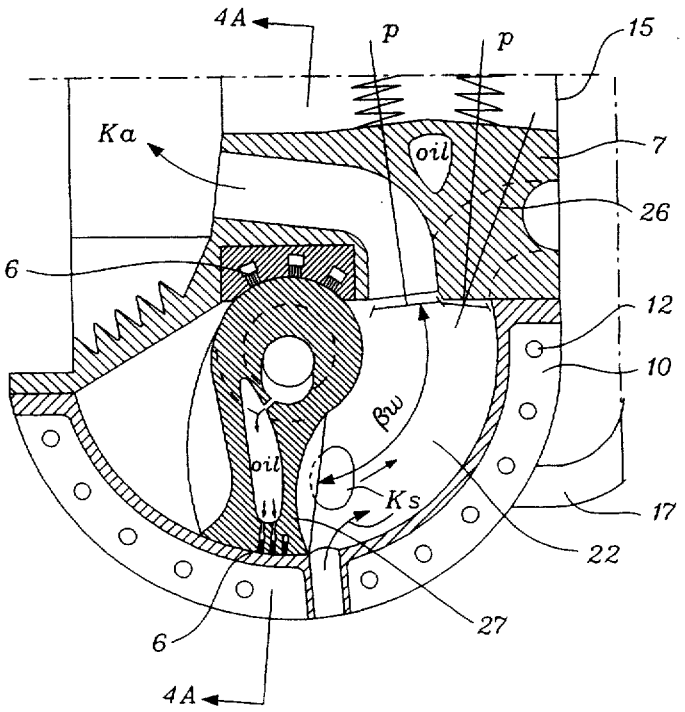
Figure 4C:
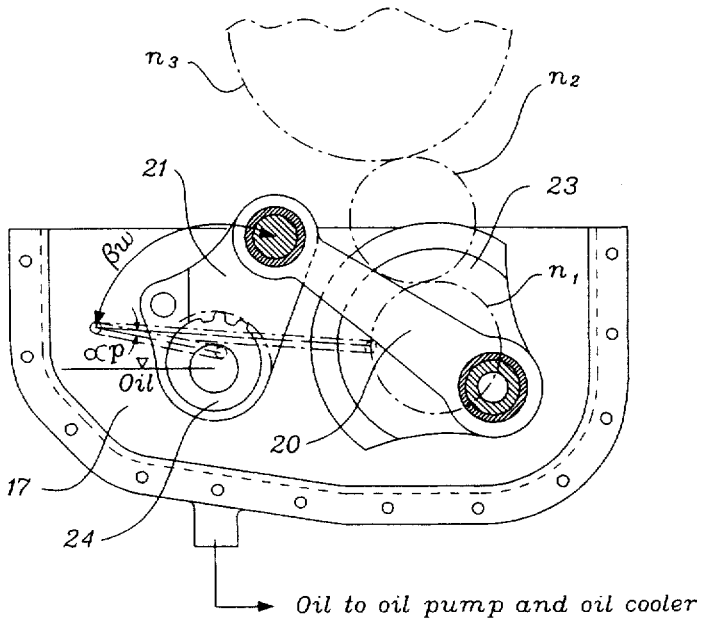

LEGENDS $\alpha p$—angle between swing arm and crankshaft axes in the reversing position of the pendulum element. The choice of p determines the instantaneous value of the transposition of the crank system in relation to the swing system iz, which can range up to ca. 1.9 at a certain point of the swing arm angular path with a pendulum angle $\beta w=110°$. The position of the swing arm relative to the crank system is shown in FIG. 2 of Appendix 3.

$$iz = \frac{rkz}{rwz}$$

βw—angle between the reversing positions of the pendulum element. The choice of this component determines the pendulum (stroke) volume.

Pkt.1—Reversing position at the combustion chamber head.

Pkt.2—Reversing position of the crank.

rw—Swing arm radius.

rwz—variable swing arm (theoretical), vertical in the direction of the force acting along the connecting rod axis.

rk—crank arm in the crank system (constant radius).

rkz—variable crank arm (theoretical), vertical in the direction of the force acting on the connecting rod.

Pkt.z—axial position of the connecting rod head on the curvature determined by the swing arm radius.

Pkt.z'—axial position of the connecting rod foot in connection with point (Pkt) z on the curvature determined by the crank radius.

Mwz—the pendulum moment variable in value and direction.

n.Mkz—direction of rotation and action of the crank torque variable in value.

k—connecting rod.

n . . . —number of rotations and direction.

Ka—exhaust channel.

Ks—intake channel.

Rs—intake pipe.

Vs—intake valve.

Va—exhaust valve.

Pu—reversal point (I and II) of the pendulum element.

Öl—lubricating and cooling oil

LISTING OF REFERENCE NUMBERS

| Item | Name |
|---|---|
| 1 | Camshaft |
| 2 | Valve lever |
| 3 | Valve spring |
| 4 | Exhaust valve |
| 5 | Intake valve |
| 6 | Sealing segments (between combustion chambers, blades and the lateral surfaces of the pendulum element) |
| 7 | Combustion chamber head with valve control gearing (3 exhaust valves) |
| 8 | Reciprocating shaft channel |
| 9 | Pendulum element |
| 10 | Housing |
| 11 | Cooling water chamber |
| 12 | Threaded joints |
| 13 | Roller bearing |
| 14 | Valve control gearing |
| 15 | Hood |
| 16 | Crank-swing arm system |
| 17 | Housing of the crank-swing arm system |
| 18 | Packing |
| 19 | Lateral hoods of the working chamber |
| 20 | Connecting rod |
| 21 | Swing arm |
| 22 | Combustion chamber |

-continued

| Item | Name |
|---|---|
| 23 | Small flywheel |
| 24 | Reciprocating shaft |
| 25 | Crankshaft |
| 26 | Sparkplug with spark ignition, injection with self-ignition |
| 27 | Oscillating unit (pendulum element, reciprocating shaft, swing arm) |
| 28 | Blades and their shapes |

Referring to the Figures, the operation of the invention will be described.

The force impulses from the combustion gases act on a blade-like component (9) and are converted via the dynamic unit into a torque. As depicted in the kinematics scheme, FIG. 1 of the drawings, the pressure increase resulting from the combustion of the fuel-air mixture in the combustion chamber acts on the blade of a pendulum element (9) and produces the pendulum moment. This moment is converted via the reciprocating shaft (24), swing arm (21) and connecting rod (20) into the torque in the crank system (16) and finally transferred to the large flywheel (FIG. 1). (See legend for p and βw.)

The design of a four-cycle engine with two 2-blade pendulum units, 4 combustion chambers (=2 working chambers) is contained in FIG. 3. Complete symmetry in all cycles (inlet, compression, work and exhaust) is thus achieved. A multiplicity of the system is feasible (e.g., 8, 12, 16, . . . combustion chambers). Referring to FIGS. 3A and 3B, the reciprocating element 9 has a working surface which is generally trapezoidal in shape (with a rounded head). Because of the orientation of the trapezoidally shaped member, the working surface is enlarged from the shaft outward and presents an increasingly wider surface area at locations more distant from shaft 24.

(a) Mode of operation of a four-cycle engine in the symmetric system—with four combustion chambers (2 units are symmetrically arranged on both sides of the crank-swing arm system) or a multiplicity of this system.

| | Right Unit | | Left Unit | |
|---|---|---|---|---|
| Operating Cycle | Combustion Chamber 1 | Combustion Chamber 2 | Combustion Chamber 3 | Combustion Chamber 4 |
| 1 | working | exhaust | intake | compression |
| 2 | exhaust | intake | compression | working |
| 3 | intake | compression | working | exhaust |
| 4 | compression | working | exhaust | intake |

In each operating cycle, the pendulum units move in a specific oscillating angle in which the crankshaft rotates 180° by means of the crank-swing arm system.

The design of a two-cycle engine with two 1-blade pendulum units, 2 combustion chambers (=2 working chambers) is contained in FIG. 4.

A multiplicity of the system is feasible (e.g., 1, 2, 4, 6 . . . combustion chambers).

(b) Mode of operation of a two-cycle engine in the symmetric system with two combustion chambers (2 pendulum units are symmetrically arranged on both sides of the crank-swing arm system). The operating cycle in combustion chamber 1 gives this unit an angular motion and triggers the pendulum moment, which is transferred to the crank system (via the crank-swing arm mechanism) to be converted there into the torque. At this point in time, the compression of the charge (air or fuel-air mixture) to the required pressure takes place in combustion chamber 22. Release of the exhaust gases takes place in the final phase of the relaxation (working cycle) by escape through the valves located in the combustion chamber head. Opening and closing of the intake channels are effected by the blades of the pendulum unit.

Conducting the initial charging process via few operating cycles is provided by means of a compressor.

The unconventional construction herein described and claimed is a completely new system that revolutionizes the construction of internal combustion engines. This innovative development provides a number of advantages in addition to the considerable high efficiency. For example, a halving of the waste gas emission is expected. The weight and also the space required of the engine is reduced to two-thirds in comparison with piston engines. This operating technique will be used not only in engines in motor vehicles but in various other engine powered devices. Further detailed studies will lead to individual structural solutions and confirm the versatility of this innovation.

While certain presently preferred embodiments of the present invention have been described and illustrated, it is to be distinctly understood that the invention is not limited thereto but may be otherwise embodied and practiced within the scope of the following claims.

We claim:

1. Swivel-blade internal combustion engine which produces gas pressure energy for two-cycle and four-cycle operation comprising:

a reciprocating shaft (24);

a reciprocating element (9) supported on said reciprocating shaft (24), said reciprocating element (9) having a working surface adapted and positioned to receive gas pressure energy for producing an oscillating pendulum moment in the reciprocating element, said working surface having a shape which deviates from both a rectangular and circular segment form, said working surface having a wider surface area presented at locations more distant from the reciprocating shaft (24);

rocker arm means (16) for converting the pendulum moment into the torque of a crankshaft (25), said rocker arm means further comprising a swing arm (21) fixed solidly on the reciprocating shaft (24), said swing arm (21) spanning a pendulum angle $\beta w$ of a minimum of 90° and a maximum of 130° and having an angle $\alpha p$ which moves in a range greater than 0° up to a maximum of 30° and an articulated connecting rod (20) connected to the swing arm and to the crankshaft through which the pendulum moment is passed to the crankshaft.

2. Swivel-blade internal combustion engine according to claim 1 wherein said working surface of the reciprocating element (9) has a trapezoidal shape which is enlarged from the shaft outward and is rounded on the head.

3. Swivel-blade internal combustion engine according to claim 1 wherein the reciprocating element (9) includes two blades, and said engine has two combustion chambers and only one working chamber.

4. Swivel-blade internal combustion engine according to claim 1 wherein the reciprocating element (9) includes only a singular blade, and said engine has only one combustion chamber and only one working chamber.

5. Swivel-blade internal combustion engine which produces gas pressure energy for two-cycle and four-cycle operation comprising:

a reciprocating shaft (24);

a reciprocating element (9) supported on said reciprocating shaft (24), said reciprocating element (9) having a working surface adapted and positioned to receive the gas pressure energy for producing an oscillating pendulum moment in the reciprocating element, said working surface having a shape which deviates from a rectangular form;

rocker arm means (16) for converting the pendulum moment into the torque of a crankshaft, said rocker arm means further comprising a swing arm (21) fixed solidly on the reciprocating shaft (24) and an articulated connecting rod (20) connected to the swing arm and to the crankshaft through which the pendulum moment is passed to the crankshaft wherein a change in the compression through a change in the length of the swing arm (21) is achieved by means of eccentricity of the swing arm pin.

6. Swivel-blade internal combustion engine which produces gas pressure energy for two-cycle and four-cycle operation comprising:

a reciprocating shaft (24);

a reciprocating element (9) supported on said reciprocating shaft (24), said reciprocating element (9) having a working surface adapted and positioned to receive gas pressure energy for producing an oscillating pendulum moment in the reciprocating element, said working surface having a shape which deviates from both a rectangular and circular segment form, said working surface having a wider surface area presented at locations more distant from the reciprocating shaft (24);

rocker arm means (16) for converting the pendulum moment into the torque of a crankshaft (25), said rocker arm means further comprising a swing arm (21) fixed solidly on the reciprocating shaft (24) and an articulated connecting rod (20) connected to the swing arm and to the crankshaft through which the pendulum moment is passed to the crankshaft, said swing arm (21) spanning a pendulum angle $\beta w$ of a minimum of 90° and a maximum of 130° and having an angle $\alpha p$ between the swing arm and crankshaft in the reversing position of the pendulum element which moves in a range greater than 0° up to a maximum of 30°, and wherein said reciprocating element (9) has a left-hand direction of rotation.

7. Swivel-blade internal combustion engine according to claim 6 wherein said working surface of the reciprocating element (9) has a trapezoidal shape which is enlarged from the shaft outward and has one of a rounded head and a flat head.

8. Swivel-blade internal combustion engine according to claim 6 wherein the reciprocating element (9) consists of one blade, and said engine has one combustion chamber and one working chamber.

9. Swivel-blade internal combustion engine according to claim 6 wherein the reciprocating element (9) comprises two blades, and said engine has two combustion chambers and only one working chamber.

10. Swivel-blade internal combustion engine according to claim 8 wherein the swing arm (21) sweeps over a pendulum angle of $\beta w$ of a minimum of 90° and a maximum of 130° and having an angle $\alpha p$ which moves in a range larger than 0° to a maximum of 20°.

11. Swivel-blade internal combustion engine according to claim 9 wherein the swing arm (21) sweeps over a pendulum angle of $\beta w$ of a minimum of 90° and a maximum of 130° and having an angle $\alpha p$ which moves in a range larger than 15° to a maximum of 35 °.

12. Swivel-blade internal combustion engine according to claim 6 which facilitates a correction in the degree of compression by one of:

a) varying the length of the swing arm (21) by means of an eccentric oscillating arm bolt or exchange if the swing arm; and b) correcting the position setting of the working range together with the combustion chamber head to the blade with the aid of the angle regulation of this periphery to the other construction.

* * * * *

UNITED STATES PATENT AND TRADEMARK OFFICE

CERTIFICATE OF CORRECTION

PATENT NO. : 5,699,757
DATED : December 23, 1997
INVENTOR(S) : Georg B. Wollny et al.

It is certified that error appears in the above-identified patent and that said Letters Patent is hereby corrected as shown below:

The title page should be deleted to appear as per attached title page.

The Drawing sheets 1-7 should be deleted to appear as per attached drawing sheets 1-7.

Signed and Sealed this

Sixteenth Day of June, 1998

*Attest:*

Bruce Lehman

BRUCE LEHMAN

*Attesting Officer*

*Commissioner of Patents and Trademarks*

United States Patent [19]

Wollny et al.

[11] Patent Number: 5,699,757

[45] Date of Patent: Dec. 23, 1997

[54] INTERNAL COMBUSTION ENGINE

[76] Inventors: Georg B. Wollny, Sudetenstrasse 19, D-82515 Wolfratshausen, Germany; Marian Chmiel, ul. Morcinka 2a/5, PL 57-300 Klodzko, Poland

[21] Appl. No.: 718,676

[22] Filed: Sep. 24, 1996

[51] Int. Cl.[6] ..... F02B 53/00

[52] U.S. Cl. ..... 123/18 R

[58] Field of Search ..... 123/18 R, 61 R

[56] References Cited

U.S. PATENT DOCUMENTS

| | | | |
|---|---|---|---|
| 1,113,262 | 10/1914 | Twombly | 123/18 R |
| 1,468,516 | 9/1923 | Schiller | 123/18 R |
| 1,940,788 | 12/1933 | Davis | 123/18 R |
| 3,190,270 | 6/1965 | Peterson | 123/18 R |
| 3,408,991 | 11/1968 | Davis | 123/18 R |
| 4,599,976 | 7/1986 | Meuret | 123/18 R |
| 4,884,532 | 12/1989 | Tan et al. | 123/18 R |
| 5,152,254 | 10/1992 | Sakita | 123/18 R |
| 5,228,414 | 7/1993 | Crawford | 123/18 A |

FOREIGN PATENT DOCUMENTS

| | | |
|---|---|---|
| 2639530 | 3/1978 | Germany . |
| 4324097 | 1/1995 | Germany . |

*Primary Examiner*—David A. Okonsky
*Attorney, Agent, or Firm*—Thomas R. Shaffer, Esq.

[57] ABSTRACT

A swivel-blade internal combustion engine which produces gas pressure energy for two-cycle and four-cycle operation is disclosed. The engine includes a reciprocating shaft (24) and a reciprocating element (9) supported on the reciprocating shaft. The reciprocating element (9) has a working surface adapted and positioned to receive the gas pressure energy for producing an oscillating pendulum moment in the reciprocating element. The working surface of the reciprocating element preferably has a trapezoidal shape which is rounded on the head. A rocker arm system (16) is provided for converting the pendulum moment into the torque of a crankshaft. The rocker arm system includes a swing arm (21) fixed solidly on the reciprocating shaft (24) and an articulated connecting rod (20) connected to the swing arm and to the crankshaft through which the pendulum moment is passed to the crankshaft.

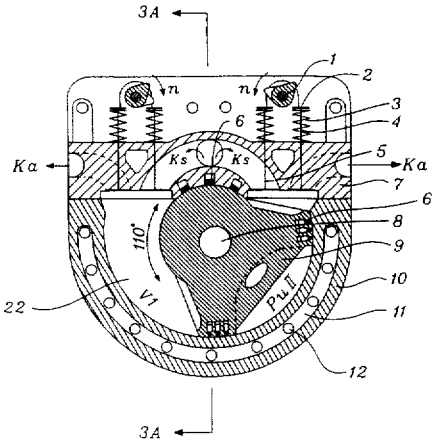

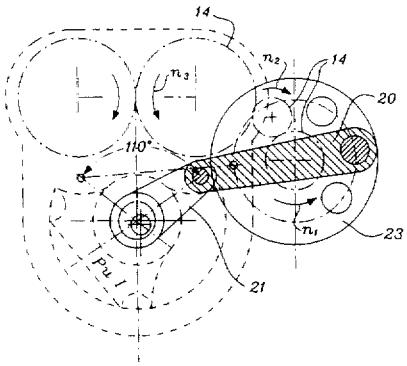

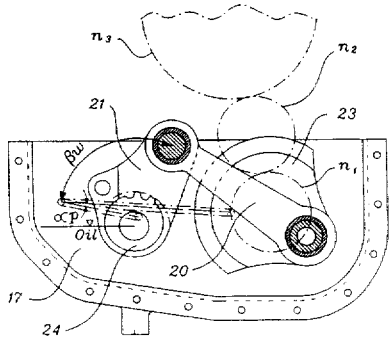

12 Claims, 7 Drawing Sheets